United States Patent [19]

Seidl et al.

[11] Patent Number: 4,773,366

[45] Date of Patent: Sep. 27, 1988

[54] NON-FOAMING CRANKCASE CONFIGURATION FOR PISTON INTERNAL-COMBUSTION ENGINES

[75] Inventors: Jiri Seidl, Munich; Franz Zinnecker, Karlsfeld, both of Fed. Rep. of Germany

[73] Assignee: Bayerische Motoren Werke Aktiengesellschaft, Munich, Fed. Rep. of Germany

[21] Appl. No.: 917,091

[22] Filed: Oct. 7, 1986

Related U.S. Application Data

[63] Continuation of PCT EP85/00678 filed on Dec. 6, 1985, published as W086/03551, Jun. 19, 1986.

[30] Foreign Application Priority Data

Dec. 8, 1984 [DE] Fed. Rep. of Germany ..... 3444838

[51] Int. Cl.[4] ..... F01M 11/02

[52] U.S. Cl. ..... 123/196 R; 123/195 C; 184/13.1

[58] Field of Search ..... 123/196 R, 196 CP, 196 S, 123/195 R, 195 C; 184/6.21, 6.23, 11.1, 11.2, 11.4, 13.1

[56] References Cited

U.S. PATENT DOCUMENTS

| | | | |
|---|---|---|---|
| 1,717,872 | 6/1929 | Brush et al. | 184/13.1 |
| 1,948,810 | 2/1934 | Tyler | 123/192 B |
| 2,955,675 | 10/1960 | Leach | 123/196 R |
| 3,014,554 | 12/1961 | Etchells et al. | 123/196 R |
| 4,033,312 | 7/1977 | Howe | 123/196 R |
| 4,270,497 | 6/1981 | Valerio | 123/195 C |
| 4,538,565 | 9/1985 | Hidaka et al. | 123/196 R |

FOREIGN PATENT DOCUMENTS

| | | |
|---|---|---|
| 1948186 | 4/1971 | Fed. Rep. of Germany . |
| 1964049 | 7/1971 | Fed. Rep. of Germany . |
| 3334044 | 3/1985 | Fed. Rep. of Germany . |
| 58-88416 | 5/1983 | Japan . |
| 1095948 | 12/1967 | United Kingdom . |

*Primary Examiner*—Ira S. Lazarus
*Assistant Examiner*—Sue Hagarman
*Attorney, Agent, or Firm*—Barnes & Thornburg

[57] ABSTRACT

An engine block comprises a top part of the crankcase that is reinforced by a separate bottom part of the crankcase with an oil pan arranged at an exterior case wall of the bottom part of the crankcase configured so that the lubricating oil to be returned from the upper case area into the oil pan is not taken along by rotating engine components because, the bottom part of the crankcase has a lubricating-oil passage that is arranged in a fastening flange and leads out between the exterior case wall and an interior case wall, wherein the interior case wall, as a semicylindrical shell and, is arranged so that it extends close to the contour of the connecting-rod "violin" arrangement and forms a reinforcing connection to an additional opposite fastening flange of the bottom part of the crankcase and wherein the shell that separates the crank space from a space above the oil pan additional passages that are preferably arranged tangentially with respect to the shell for the discharge of lubricating oil coming out of the bearings of the engine components.

4 Claims, 1 Drawing Sheet

NON-FOAMING CRANKCASE CONFIGURATION FOR PISTON INTERNAL-COMBUSTION ENGINES

BACKGROUND AND SUMMARY OF THE INVENTION

This application is a continuation application under 35 U.S.C. §111 of European Patent Application No. PCT/EP 85/00678 filed on Dec. 6, 1985 in the European Patent Office and published as W086/03551, Jun. 19, 1986, benefits under 35 U.S.C. §§120 and 365(c) are claimed. The European Application claims priority of German Application No. P 34 44 838.1 filed on Dec. 8, 1984 in the Federal Republic of Germany and benefits under 35 U.S.C. §119 are claimed with respect thereto.

The invention, comprises a crankcase for piston internal-combustion engines, particularly an engine block, having a top part of the crankcase and a separate bottom part of the crankcase that has an exterior case wall and an interior case wall that connects opposite parts of the exterior case wall with one another, said bottom part of the crankcase that reinforces the top part of the crankcase having free passages for the returning of lubricating oil that is collected in an oil pan that is detachably fastening at the exterior case wall and is based on U.S. Pat. No. 1,948,810.

In the case of the known construction, the interior case wall forms a transverse wall that reinforces the bottom part of the crankcase in vertical direction. The transverse wall in this case is arranged in the area of a central crankshaft bearing and has a bearing cap that is shaped onto it. On both sides of this transverse wall, when the internal-combustion engine is in operation, the lubricating oil flowing back from the upper area of the case, especially a cylinder head, falls freely into the oil pan that is connected to the bottom part of the crankcase. In this case, a part of the returning lubricating oil can be taken up by rotating engine components, in which case oil that is thrown off the engine components causes an extensive foaming of the lubricating oil flowing back at the case walls. It is known that heavily foamed oil is a considerable disadvantage, especially when hydraulic valve-play compensation elements are used.

An object of the invention is to overcome the disadvantages of the prior art.

A further object of the invention is to produce a case of this type in such a way that lubricating oil flowing back from the upper area of the case is guided back into the oil pan away from the rotating engine components.

A still further object of the invention is to produce a crankcase wherein a return-flor line in the top part of the crankcase is an oil-guiding connection with a passage arranged in a fastening flange of the bottom part of the crankcase, said passage leading out between the exterior case wall and the interior case wall arranged so that it extends close to the contour of the connecting-rod "violin" arrangement, the interior case wall forming a connection, that delimits the crank space, to an additional opposite fastening flange of the crankcase bottom part and having additional passages that are distributed at the circumference, said passages connecting the crank space with the oil pan.

A feature of the invention is a line arranged in the top part of the crankcase for returning lubricating oil that discharges into a space above the oil pan that is separated from the crank space of the rotating engine components by means of a semicylindrical shell of the bottom part of the crankcase. For the discharge of the lubricating oil coming out of the bearings of the rotating engine components, this shell that forms the interior case wall of the bottom part of the crankcase has separate passages. This shell combines the advantage of the lubricating oil that is led past the rotating engine components with the advantage of an effective reinforcement of the crankcase.

It is true that on the basis of DE-PS 10 43 710 a bottom part of a crankcase is known that is developed as a semicylindrical shell for a connection with a top part of the crankcase, but it is meant for the case of a two-cycle internal-combustion engine. Since in such a case, the lubricating oil is led to the corresponding bearings of the crankshaft in a condition in which it is atomized with the fuel-air mixture in the crankcase pumps, the problem of the initially described lubricating-oil return does not exist in this case. Thus there is also no suggestion to arrange a semicylindrical shell in a bottom part of the crankcase of this type.

In addition, on the basis of DE-OS 19 64 049, a crankcase for a piston internal-combustion engine is known that is of a different type and comprises walls that are pulled down far over the center of the crankshaft, said walls being connected with an oil pan. In the area of the connecting rod bearings, interior case walls are in each case assigned to the exterior case walls extending approximately from the center of the crankshaft near the contours of connecting-rod "violin" arrangements. It is true that the interior case wall and the exterior case wall are used for guiding lubricating oil flowing back from the upper area of the case past, into the oil pan, but the interior case walls do not form a component that essentially separates the crank space from the oil pan.

It is another object of the invention to provide a crankcase wherein the bottom part thereof is developed as a light metal die-cast part and wherein the interior case wall has a semicircular arched cross-section and has passages that are arranged approximately tangentially with respect to the wall.

In addition, the bottom part of the crankcase, via the semicylindrical shell, for a further reinforcement, according to the arrangement of DE-PS 10 43 710, can be screwed together with the bearing caps of the crankshaft bearing in a stop arrangement. Finally, for the same purpose, and as already known from U.S. Pat. No. 3,421,490, the bearing caps can be connected in one piece with the bottom part of the crankcase.

This and other objects, features and advantages of the present invention will become more apparent from the following descriptions when taken in connection with the accompanying drawings which show, for the purposes of illustration only, embodiments in accordance with the present invention.

BRIEF DESCRIPTION OF THE DRAWINGS

Embodiments of the invention are shown in the drawing.

DETAILED DESCRIPTION OF THE DRAWINGS

Figure 1:
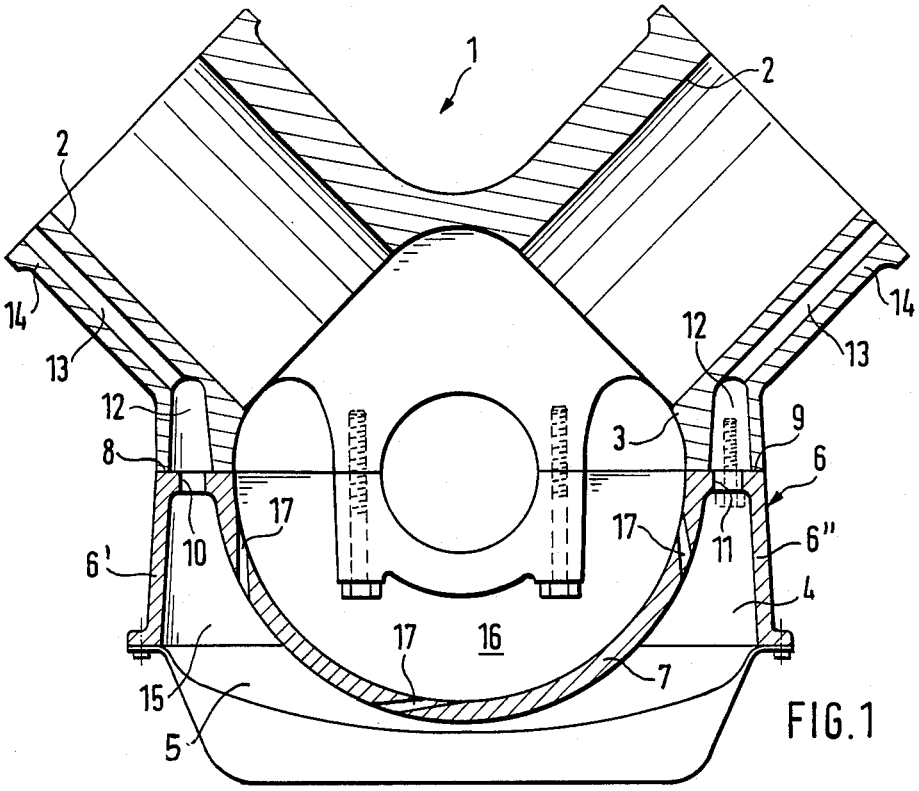
FIG. 1 is a cross-sectional view of a case for a piston internal-combustion engine.

Referring now to the drawings wherein like reference numerals are used to designate like parts and more particularly to FIG. 1, which is an engine block 1 for a piston internal-combustion engine having cylinders 2 that are arranged in a V-shape has a top part 3 of a crankcase and a separate bottom part 4 of the crankcase that itself is closed in downward direction by means of an oil pan 5. The bottom part 4 of the crankcase has an exterior case wall 6 from which parts 6' and 6" that are opposite one another are connected with one another by means of an interior case wall 7. The interior case wall 7 has a semicircular arched cross-section and extends close to the contour of the connecting rod "violin" arrangements. In addition, the interior case wall 7, on one side, is connected with the exterior case wall part 6' via a fastening flange 8, and, on the other side, is connected via a fastening flange 9, with the exterior case wall part 6". First lubricating-oil passages 10 and 11 are in each case developed in the fastening flanges 8 and 9. Each of the passages 10 and 11 is in each case in an oil-guiding connection with a chamber 12 in the top part 3 of the crankcase. Each chamber 12, through a return-flow duct 13 in the cylinder shell 14, receives the lubricating oil discharged by the cylinder heads that are not shown. Via the passages 10 and 11, the returning lubricating oil enters a space 15 above the oil pan 5 that, by means of the separating wall 7, is largely separated from the crank space 16 of the rotating engine components. Thus, the lubricating oil returning from the upper case areas reaches the oil pan 5 in an unfoamed condition.

For the discharge of the lubricating oil flowing out of the bearings of the engine components, the interior case wall 7 developed as a semicylindrical shell has additional passages 17 that connect the crank space 16 with the space 15 above the oil pan 5. These second free passages 17 that are arranged so that they are distributed over the circumference of the case wall 7 are arranged approximately tangentially with respect to the case wall 7. When the bottom part 4 of the crankcase is developed as a light-metal die-cast part, these second passages 17 may be shaped during casting.

Figure 2:
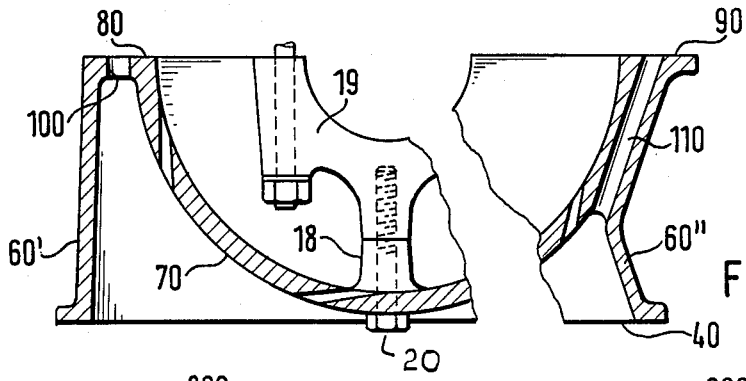
FIG. 2 is a changed bottom part of the crankcase that is detachably connected with a bearing cap.

FIG. 2 shows a bottom part 40 of the crankcase in which an exterior case wall part 60" is lower with respect to the interior case wall 70 and is arranged to extend to a level more closely corresponding to that of the separating interior case wall 70. The first passage 110 that starts at the flange 90 in this case is developed like a duct and leads out between the case wall part 60" and the interior case wall 70. For the additional reinforcement, the bottom part 40 of the crankcase, via lengthenings 18 at the interior case wall 70, comes to rest against bearing caps 19 and is screwed to these by bolts such as 20.

Figure 3:
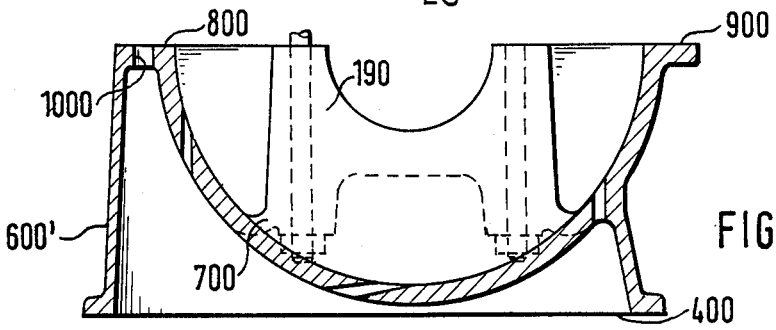
FIG. 3 is a further development of a bottom part of the crankcase with an integrated bearing cap.

The bottom part 400 of the crankcase according to FIG. 3 has a first free passage 1000 for the undisturbed return of the lubricating oil from the upper case area into the oil pan only in the fastening flange 800. For an additional reinforcement, bearing caps 190 are constructionally integrated with the bottom part 400 of the crankcase via the interior case wall 700.

While we have shown and described embodiments in accordance with the present invention, it is understood that the same is not limited thereto but is susceptible to numerous changes and modifications as known to one having ordinary skill in the art, and we therefore do not wish to be limited to the detailed shown and described herein, but intend to cover all such modifications are encompassed by the scope of the appended claims.

What is claimed:

1. For an internal combustion engine having a block with oil return flow chambers, a crankcase bottom comprising:

an exterior wall, flange means mounted to the exterior wall for mounting the crankcase bottom to the block, means for assisting the flange means in mounting the crankcase bottom to the block for reducing lubricant foaming comprising an interior wall connected to the flange means and forming an oil passage between the interior and exterior walls which communicates with the return flow chambers, an oil pan mounted to the exterior wall, and apertures disposed in the interior wall to allow passage of oil therethrough.

2. For an internal combustion engine having a block and crankcase bottom according to claim 1, said apertures having axes which are substantially tantential to the configuration of the interior wall.

3. A crankcase for piston internal-combustion engines, having a top part and a separate bottom part having an exterior case wall, and an interior case wall means that connects opposite parts of the exterior case wall with one another, said bottom part of the crankcase reinforcing the top part of the crankcase and having passage means for returning lubricating oil to an oil pan detachably fastened at the exterior case wall, wherein a return-flow line in the top part of the crankcase is in oil-guiding connection with a first of said passage means which is arranged in a fastening flange sharing opposing parts of the bottom and top part of the crankcase, said first passage means leading between the exterior case wall and the interior case wall means, the interior case wall means extending close to and defining a bottom area of the engine which houses cranks and connecting-rods, the interior case wall means forming a connection between opposing parts of the fastening flange of the crankcase bottom part to assist the flanges in supporting the top part, the interior case wall means having additional passage means that are distributed in a circumference of the interior case wall means, said additional passage means connecting the area of the engine which houses the cranks and connecting rods with the oil pan.

4. A crankcase according to claim 3, wherein the bottom part is developed as a light-metal die-cast part and wherein the interior case wall means has a semicircular arched cross-section and said additional passage means are arranged such that axes of flow thereof are approximately tangential with respect to a surface of the interior case wall.

* * * * *